US008917578B2

(12) United States Patent
Takenawa

(10) Patent No.: US 8,917,578 B2
(45) Date of Patent: Dec. 23, 2014

(54) INFORMATION DISPLAY DEVICE AND ELECTRONIC TIMEPIECE

(71) Applicant: Casio Computer Co. Ltd., Tokyo (JP)

(72) Inventor: Hideo Takenawa, Hachioji (JP)

(73) Assignee: Casio Computer Co., Ltd., Tokyo (JP)

( * ) Notice: Subject to any disclaimer, the term of this patent is extended or adjusted under 35 U.S.C. 154(b) by 0 days.

(21) Appl. No.: 13/863,778

(22) Filed: Apr. 16, 2013

(65) Prior Publication Data

US 2013/0279301 A1 Oct. 24, 2013

(30) Foreign Application Priority Data

Apr. 18, 2012 (JP) ..... 2012-094389

(51) Int. Cl.

| | |
|---|---|
| ***G04C 17/00*** | (2006.01) |
| ***G04B 19/247*** | (2006.01) |
| ***G04C 3/00*** | (2006.01) |
| ***G04C 3/14*** | (2006.01) |

(52) U.S. Cl.

CPC ..... *G04C 3/008* (2013.01); *G04C 17/0058* (2013.01); *G04C 17/005* (2013.01); *G04C 3/14* (2013.01)

USPC ..... 368/37; 368/77; 368/233

(58) Field of Classification Search

CPC ..... G04C 17/005; G04C 17/0058

USPC ..... 368/28, 35, 37, 77, 220, 221, 223, 244; 310/323.01, 323.06, 323.16

See application file for complete search history.

(56) References Cited

U.S. PATENT DOCUMENTS

| | | | | |
|---|---|---|---|---|
| 5,055,732 | A * | 10/1991 | Umemura | 310/323.04 |
| 5,204,577 | A * | 4/1993 | Watanabe et al. | 310/323.08 |
| 6,088,300 | A * | 7/2000 | Nakajima et al. | 368/28 |
| 6,266,296 | B1 * | 7/2001 | Miyazawa | 368/28 |
| 6,515,941 | B1 * | 2/2003 | Suzuki et al. | 368/28 |
| 7,772,744 | B2 * | 8/2010 | Ishiguro et al. | 310/323.09 |
| 2004/0156274 | A1 * | 8/2004 | Miyazawa et al. | 368/255 |
| 2007/0008829 | A1 * | 1/2007 | Kitahara et al. | 368/255 |

FOREIGN PATENT DOCUMENTS

JP 05-087950 A 4/1993

* cited by examiner

*Primary Examiner* — Vit W Miska

(74) *Attorney, Agent, or Firm* — Holtz, Holtz, Goodman & Chick PC

(57) ABSTRACT

An information display device of the present invention includes an hour plate having an opening, a rotor which is rotatably placed below the hour plate and has a display section which is partially exposed corresponding to the opening of the hour plate, and a braking member which gives a load to the rotor when the rotation of the rotor is stopped, and reduces the load on the rotor when the rotor is rotating.

10 Claims, 11 Drawing Sheets

INFORMATION DISPLAY DEVICE AND ELECTRONIC TIMEPIECE

CROSS-REFERENCE TO RELATED APPLICATION

This application is based upon and claims the benefit of priority from the prior Japanese Patent Application No. 2012-094389, filed Apr. 18, 2012, the entire contents of which is incorporated herein by reference.

BACKGROUND OF THE INVENTION

1. Field of the Invention

The present invention relates to an information display device for use in an electronic device such as an electronic watch, and an electronic timepiece including the information display device.

2. Description of the Related Art

For example, as described in Japanese Patent Application Laid-Open (Kokai) Publication No. Heisei 05-87950, an electronic watch has been known in which a display rotor plate is rotatably placed below an hour plate above which pointers move. By the display rotor plate being rotated by an ultrasonic motor, part of a display section such as a calendar display provided on the display rotor plate, for example, a date, is switched corresponding to a display opening of the hour plate.

The ultrasonic motor in the electronic watch described above is structured to include a ring-shaped rotor provided on the lower surface of the display rotor plate, a ring-shaped stator placed below the rotor and made of an elastic body to rotate the rotor, and a plurality of piezoelectric elements provided on the lower surface of the stator to cause the stator to generate oscillatory waves. When the plurality of piezoelectric elements are sequentially energized to be deformed, the deformation causes the stator to generate oscillatory waves along a ring direction of the stator. The oscillatory waves cause the rotor to be rotated.

However, in the electronic watch described above, although the display rotor plate is rotated by the ultrasonic motor to allow part of the display section such as the calendar display, for example, the date, to be switched corresponding to the display opening of the hour plate, if the electronic watch receives an external impact, the display rotor plate may be rotated to shift the position of the part of the display section corresponding to the display opening of the hour plate, for example, the date.

To solve the above-described problem, it has been studied that a load is given by an energizing member such as a spring to the display rotor plate to prevent a positional shift of the display rotor plate due to an impact. In this structure, however, since a load is always given by the energizing member such as the spring to the display rotor plate, a large driving force for rotating the display rotor plate is required, and therefore the display rotor plate is not able to be smoothly rotated.

The present invention provides an information display device and electronic timepiece capable of preventing a positional shift of display such as a date even if an impact is received and smoothly switching the display without requiring a large driving force.

SUMMARY OF THE INVENTION

In accordance with one aspect of the present invention, there is provided an information display device comprising:

an hour plate which has an opening; a rotor which is rotatably placed below the hour plate, and has a display section which is partially exposed corresponding to the opening of the hour plate; and a braking member which gives a load to the rotor when rotation of the rotor is stopped, and reduces the load on the rotor when the rotor is rotating.

The above and further objects and novel features of the present invention will more fully appear from the following detailed description when the same is read in conjunction with the accompanying drawings. It is to be expressly understood, however, that the drawings are for the purpose of illustration only and are not intended as a definition of the limits of the invention.

BRIEF DESCRIPTION OF THE DRAWINGS

FIG. 4A and FIG. 4B depict a braking member in the timepiece module depicted in FIG. 2, of which FIG. 4A is an enlarged sectional view of the main section where a projection of a vibrating plate of the braking member abuts on the lower surface of a display rotor plate, and FIG. 4B is an enlarged sectional view of the main section where the projection of the vibrating plate is away from the lower surface of the display rotor plate;

FIG. 8A and FIG. 8B depict a braking member in the timepiece module depicted in FIG. 6, of which FIG. 8A is an enlarged sectional view of the main section where a projection of a vibrating plate of the braking member is away from the lower surface of a display rotor plate, and FIG. 8B is an enlarged sectional view of the main section where the projection of the vibrating plate abuts on the lower surface of the display rotor plate to push up the display rotor plate;

DETAILED DESCRIPTION OF THE PREFERRED EMBODIMENTS

First Embodiment

With reference to FIG. 1 to FIG. 4A and FIG. 4B, a first embodiment is described below in which the present invention has been applied to a pointer-type electronic watch (electronic timepiece).

Figure 1:
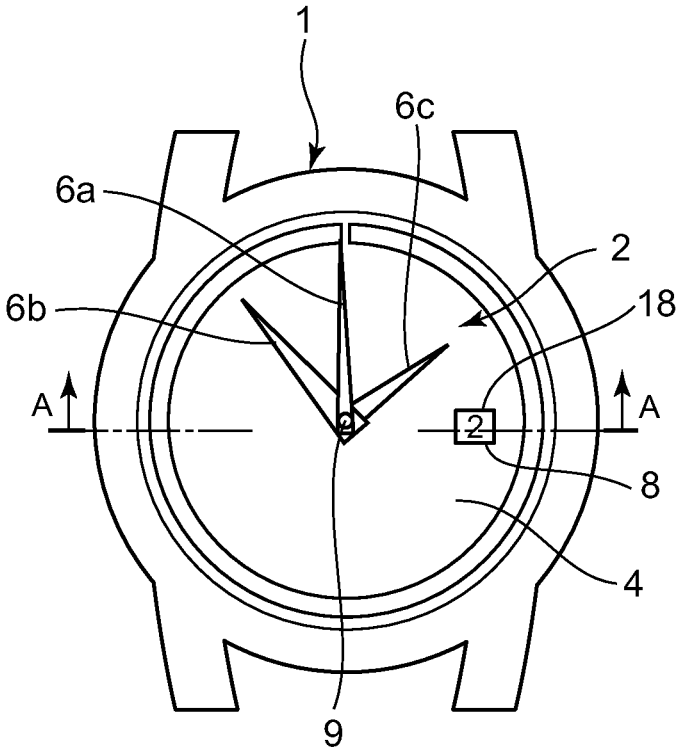
FIG. 1 is an enlarged front view of a first embodiment in which the present invention has been applied to an electronic watch.
Figure 2:
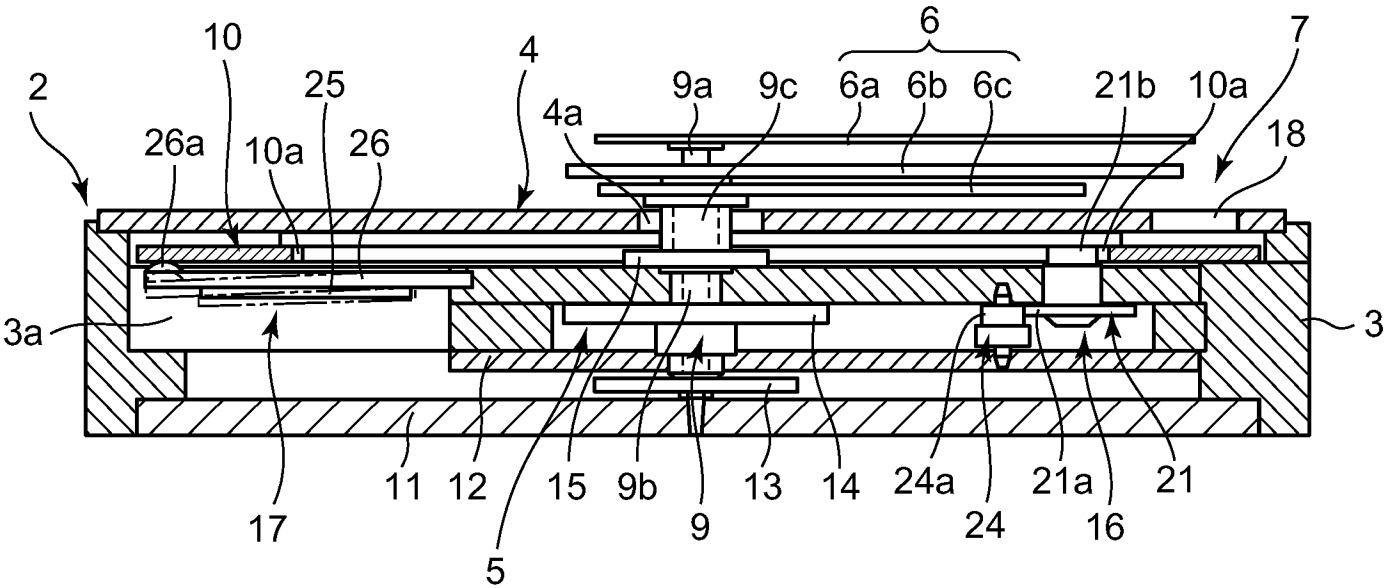
FIG. 2 is an enlarged sectional view of a timepiece module of the electronic watch taken along line A-A in FIG. 1.

The electronic watch includes a watch case 1. Inside the watch case 1, a timepiece module 2 is provided as depicted in FIG. 1 and FIG. 2. The timepiece module 2 includes a housing 3 (a fixing member).

Figure 3:
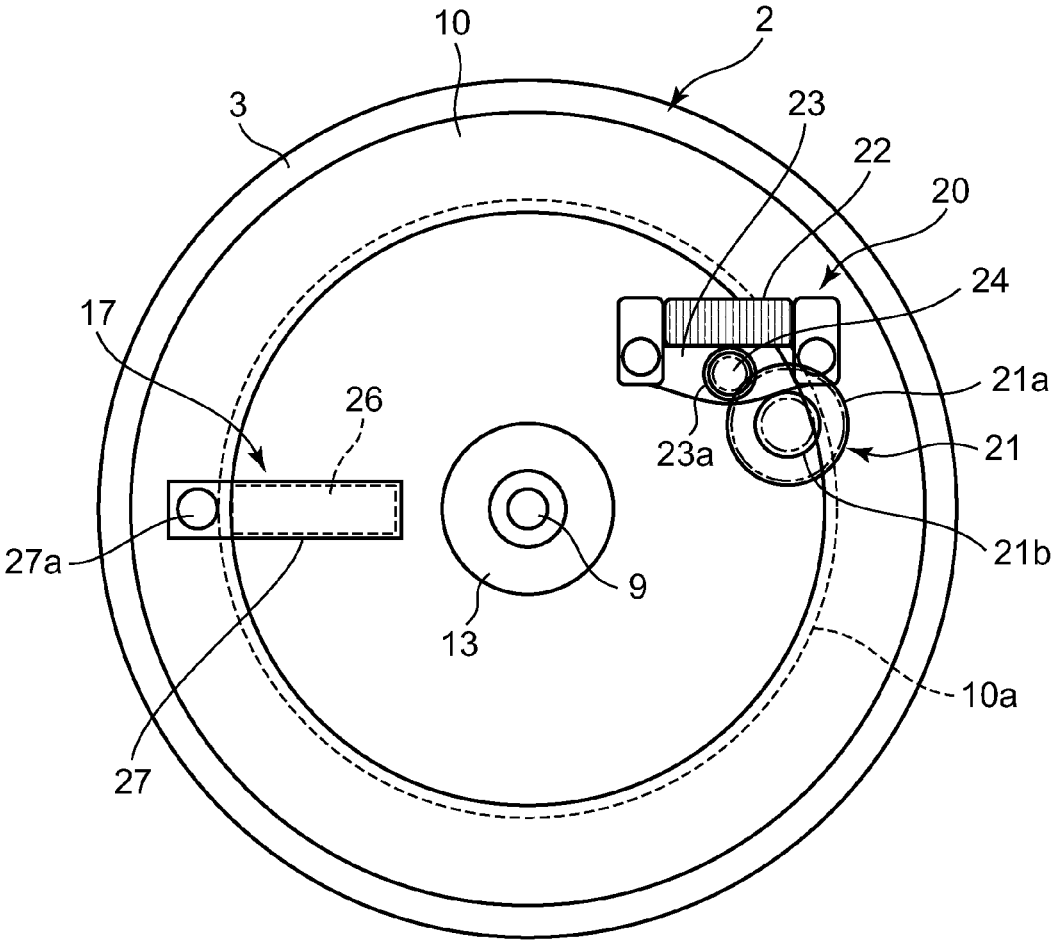
FIG. 3 is an enlarged rear view of the timepiece module depicted in FIG. 2.

As depicted in FIG. 1 and FIG. 2, an hour plate 4 is provided above the housing 3. Also, as depicted in FIG. 1 to FIG. 3, the housing 3 is provided with a timepiece mechanism section 5 that moves pointers 6 such as a second hand 6*a*, a minute hand 6*b*, and an hour hand 6*c* and a calendar mechanism section 7, which is an information display device that causes a display rotor plate 10 (a rotor) provided with a date display section 8 (a display section) to rotate to switch a date on the date display section 8.

As depicted in FIG. 2, the timepiece mechanism section 5 is structured to include a pointer shaft 9 inserted in a through hole 4*a* of the hour plate 4 to project upward from the hour plate 4. On the upper portion of the pointer shaft 9, the pointers 6 such as the second hand 6*a*, the minute hand 6*b*, and the hour hand 6*c* are mounted. With the pointers 6 moving above the hour plate 4, the time is indicated. In this case, as depicted in FIG. 2, the pointer shaft 9 includes a second hand shaft 9*a* that moves the second hand 6*a*, a minute hand shaft 9*b* that moves the second hand 6*b*, and an hour hand shaft 9*c* that moves the hour hand 6*c*.

As depicted in FIG. 2, the lower end of the second hand shaft 9*a* is rotatably mounted on a bottom board 11 provided on the lower portion of the housing 3. On this second hand shaft 9*a*, a second hand wheel 13, which is a fourth wheel, is mounted. Also, the minute hand shaft 9*b* is a cylindrical shaft and the lower portion thereof is rotatably mounted on a gear train bearing 12. On this minute hand shaft 9*b*, a second hand wheel 14, which is a center wheel, is mounted.

As depicted in FIG. 2, the second hand shaft 9*a* is rotatably inserted into the minute hand shaft 9*b*. Also, the hour hand shaft 9*c* is a cylindrical shaft and the lower portion thereof is rotatably placed on the housing 3. On this hour hand shaft 9*c*, an hour hand wheel 15, which is an hour wheel, is mounted. The minute hand shaft 9*b* and the second hand shaft 9*c* are both rotatably inserted into the hour hand shaft 9*c*.

With this, as depicted in FIG. 2, the timepiece mechanism section 5 is structured such that when the second hand wheel 13 of the second hand shaft 9*a* is rotated by a step motor (not shown), the second hand shaft 9*a* is rotated with the rotation of the second hand wheel 13 to move the second hand 6*a*. Also, the timepiece mechanism section 5 is structured such that the rotation of the second hand wheel 13 is transferred via a third wheel (not shown) to the minute hand wheel 14 of the minute hand shaft 9*b* to rotate the minute hand wheel 14, whereby the minute hand shaft 9*b* is rotated to move the minute hand 6*b* with the rotation of the minute hand shaft 9*b*.

Furthermore, as depicted in FIG. 2, the timepiece mechanism section 5 is structured such that the rotation of the minute hand wheel 14 is transferred via a day rear wheel (not shown) to the hour hand wheel 15 of the hour hand shaft 9*c* to rotate the hour hand wheel 15, whereby the hour hand shaft 9*c* is rotated to move the hour hand 6*c* together with the rotation of the hour hand shaft 9*c*, and a time is indicated with the pointers 6 such as the second hand 6*a*, the minute hand 6*b*, and the hour hand 6*c*.

On the other hand, the calendar mechanism section 7 is an information display device and includes, as depicted in FIG. 2 and FIG. 3, the display rotor plate 10 rotatably placed below the hour plate 4, a rotation driving section 16 that rotates the display rotor plate 10, and a braking member 17 that brakes the rotation of the display rotor plate 10. The display rotor plate 10 is formed in a ring shape, and is rotatably placed on the housing 3. The date display section 8 with dates from first to thirty-first days is provided on an upper surface of the display rotor plate 10.

As depicted in FIG. 1 and FIG. 2, the date display section 8 is structured so that one of the dates from first to thirty-first days is exposed corresponding to a display opening 18 (an opening) provided on the three o'clock side of the hour plate 4. As depicted in FIG. 2 and FIG. 3, the rotation driving section 16 includes a step motor 20 and a regulating wheel 21. The step motor 20 has a coil section 22, a stator 23, and a rotor 24.

With this, as depicted in FIG. 2 and FIG. 3, the step motor 20 is structured so that, when a alternating current is given to the coil section 22 to cause an alternating magnetic field at the stator 23, the rotor 24 makes step rotation with this alternating magnetic field. In this case, the rotor 24 has a magnet placed inside a hole 23*a* of the stator 23 and is rotatably mounted between the housing 3 and the gear train bearing 12. The rotor 24 is provided with a rotor pinion 24*a*.

As depicted in FIG. 2 and FIG. 3, the regulating wheel 21 is structured such that its lower portion is provided with a lower wheel gear section 21*a* that engages with the rotor pinion 24*a* of the rotor 24, and its upper portion is provided with an upper wheel gear section 21*b* that engages with inner teeth 10*a* provided to an inner perimeter of the display rotor plate 10. In this state, the regulating wheel 21 is rotatably mounted on the housing 3. With this, the regulating wheel 21 rotates with the rotation of the rotor 24 of the step motor 20. This rotation rotates the display rotor plate 10 to switch the date on the date display section 8 of the display rotor plate 10 corresponding to the display opening 18 of the hour plate 4.

On the other hand, as depicted in FIG. 2 to FIG. 4A and FIG. 4B, the braking member 17 is structured to give a load to the display rotor plate 10 when the rotation of the display rotor plate 10 is stopped, and to reduce the load to the display rotor plate 10 when the display rotor plate 10 is rotating. That is, the braking member 17 includes a piezoelectric element 25 that is deformed by energization and a vibrating plate 26 that vibrates with the deformation of the piezoelectric element 25.

In this case, as depicted in FIG. 2 to FIG. 4A and FIG. 4B, the piezoelectric element 25 is provided on the lower surface of the vibrating plate 26. The vibrating plate 26 is positioned in a brake accommodating section 3*a* provided to the housing 3, and one end (in FIG. 2, right end) of which is positioned on the center side of the display rotor plate 10 and mounted on the inner side surface of the brake accommodating section 3*a* of the housing 3. With this, the vibrating plate 26 is structured to have a tip end side positioned on the outer perimeter side of the display rotor plate 10 and warped and deformed in a vertical direction.

Figure 4A:
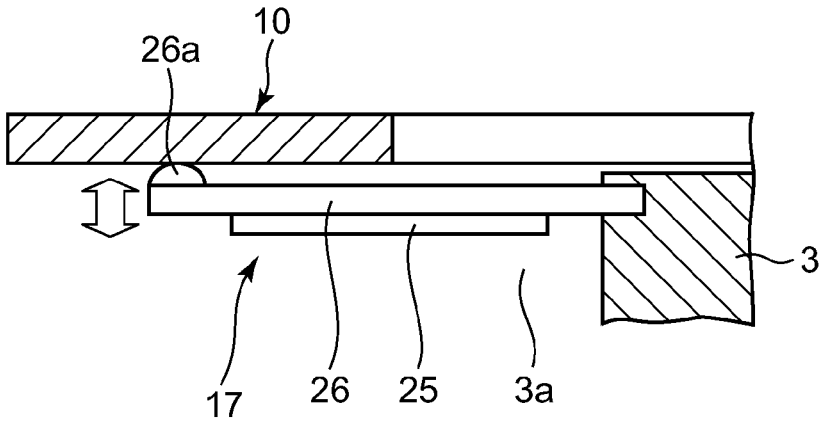

As depicted in FIG. 2 to FIG. 4A and FIG. 4B, the vibrating plate 26 is structured to have a tip end provided with a projection 26*a* projecting upward, and the projection 26*a* separably abuts on the lower surface of the display rotor plate 10. With this, as depicted in FIG. 4A, the braking member 17 is structured so that, when the piezoelectric element 25 is in a deenergized state, the projection 26*a* of the vibrating plate 26 abuts on the lower surface of the display rotor plate 10 to give a load to the display rotor plate 10.

Figure 4B:
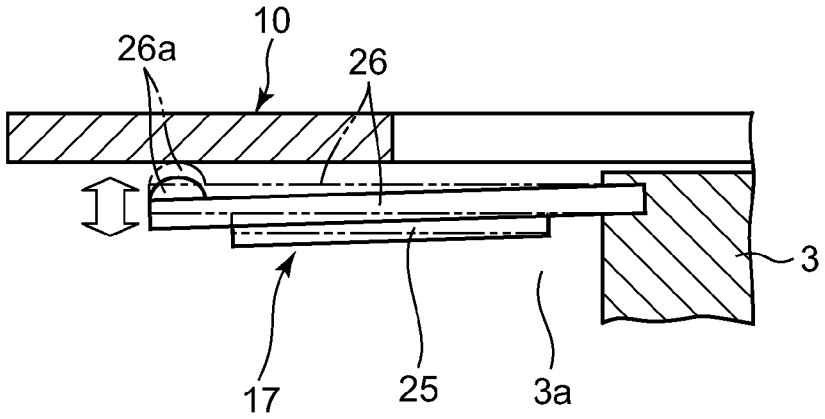

As depicted in FIG. 4B, the braking member 17 is structured so that, when the piezoelectric element 25 is in an energized state, the vibrating plate 26 is warped and deformed to vibrate in the vertical direction due to the deformation of the piezoelectric element 25, and the vibration causes the projection 26*a* of the vibrating plate 26 to be separated from and abut on the lower surface of the display rotor plate 10.

With this, the load on the display rotor plate 10 by the projection 26*a* of the vibrating plate 26 is intermittently released.

Next, the operation of the electronic watch is described.

Normally, in the electronic watch, the pointers 6 such as the second hand 6*a*, the minute hand 6*b*, and the hour hand 6*c* move above the hour plate 4 to indicate the time, with the rotation of the pointer shaft 9 such as the second hand shaft 9*a*, the minute hand shaft 9*b*, and the hour hand shaft 9*c* in the timepiece mechanism section 5. When the time at which the date is changed comes, the braking member 17 of the calendar mechanism section 7 starts operation, and the rotation driving section 16 starts operation. By the rotation driving section 16, the display rotor plate 10 is rotated to switch the date on the date display section 8.

That is, when the time at which the date is changed comes, the braking member 17 of the calendar mechanism section 7 first operates. Here, the piezoelectric element 25 is energized to be deformed. This deformation causes the vibrating plate 26 to be warped and deformed in the vertical direction to vibrate. With the vibration of the vibrating plate 26, the projection 26*a* of the vibrating plate 26 is separated from and abuts on the lower surface of the display rotor plate 10. With this, the load given to the display rotor plate 10 by the projection 26*a* of the vibrating plate 26 is intermittently released.

In this state, when the rotation driving section 16 of the calendar mechanism section 7 starts operation, the rotor 24 of the step motor 20 rotates. With the rotation of the rotor 24, the regulating wheel 21 rotates. With the rotation of the regulating wheel 21, the display rotor plate 10 rotates. Here, the projection 26*a* of the vibrating plate 26 of the braking member 17 is separated from and abuts on the lower surface of the display rotor plate 10. By the projection 26*a* of the vibrating plate 26, the load given to the display rotor plate 10 is intermittently released. Therefore, with the rotation of the regulating wheel 21, the display rotor plate 10 smoothly rotates to switch the date on the date display section 8 of the display rotor plate 10 corresponding to the display opening 18 of the hour plate 4.

As such, when the date on the date display section 8 is switched, the operation of the step motor 20 in the rotation driving section 16 of the calendar mechanism section 7 stops, and the operation of the braking member 17 of the calendar mechanism section 7 also stops. That is, when the rotation of the step motor 20 of the rotation driving section 16 stops, the rotation of the regulating wheel 21 stops, thereby stopping the rotation of the display rotor plate 10. Here, in the state where the date on the date display section 8 has been switched, the rotation of the display rotor plate 10 stops.

Also, here, the energization of the piezoelectric element 25 of the braking member 17 is cut off to cause the piezoelectric element 25 to enter a deenergized state. Then, as depicted in FIG. 4A, the projection 26*a* of the vibrating plate 26 abuts on the lower surface of the display rotor plate 10 to give a load to the display rotor plate 10. For this reason, even if the watch case 1 receives an external impact, the display rotor plate 10 is not rotated by the impact, and the state in which the date of the date display section 8 has been changed is kept.

As such, the calendar mechanism section 7 which is the information display device of the electronic watch includes the hour plate 4 having the display opening 18, the display rotor plate 10 rotatably placed below the hour plate 4, the display rotor plate 10 having the date display section 8 in which part of the dates is exposed corresponding to the display opening 18 of the hour plate 4, and the braking member 17 which gives a load to the display rotor plate 10 when the rotation of the display rotor plate 10 is stopped and reduces the load on the display rotor plate 10 when the display rotor plate 10 is rotating. This can prevent a positional shift of the date on the date display section 8 due to an impact, and can allow the date on the date display section 8 to be smoothly switched without requiring a large driving force.

That is, in the calendar mechanism section 7, when the display rotor plate 10 is rotating, the load given to the display rotor plate 10 can be reduced by the braking member 17. Therefore, the display rotor plate 10 can be smoothly rotated without requiring a large driving force. Also, when the rotation of the display rotor plate 10 is stopped, the braking member 17 can give a load to the display rotor plate 10. Therefore, the display rotor plate 10 can be prevented from being rotated by an external impact. This can prevent a positional shift of the date on the date display section 8 even if an impact is received, and can allow the date on the date display section 8 to be smoothly switched without requiring a large driving force.

In this case, the braking member 17 is structured to include the piezoelectric element 25 that is deformed by energization and the vibrating plate 26 that vibrates with the deformation of the piezoelectric element 25. When the piezoelectric element 25 is in a deenergized state, the vibrating plate 26 abuts on the display rotor plate 10 to give a load. When the piezoelectric element 25 is in an energized state, the vibrating plate 26 vibrates to intermittently release the load on the display rotor plate 10. Thus, when the display rotor plate 10 is rotating, the piezoelectric element 25 can be energized to reduce the load given to the display rotor plate 10. When the rotation of the display rotor plate 10 is stopped, the energization of the piezoelectric element 25 can be cut off to reliably give a load to the display rotor plate 10.

That is, with this braking member 17, when the piezoelectric element 25 is energized to be deformed while the display rotor plate 10 is rotating, the deformation of the piezoelectric element 25 causes the vibrating plate 26 to vibrate. Upon vibration, the vibrating plate 26 is separated from and abuts on the display rotor plate 10, thereby intermittently releasing the load on the display rotor plate 10. With this, the load given to the display rotor plate 10 can be reduced. Therefore, the display rotor plate 10 can be smoothly rotated without requiring a large driving force.

Also, with this braking member 17, when the energization of the piezoelectric element 25 is cut off to stop the deformation of the piezoelectric element 25 while the rotation of the display rotor plate 10 is being stopped, the vibrating plate 26 can abut on the display rotor plate 10 to give a load. Thus, the display rotor plate 10 can be reliably prevented from rotating by an external impact. This can reliably prevent a positional shift of the date on the date display section 8 even if an impact is received.

As described above, with this calendar mechanism section 7, when the display rotor plate 10 is rotating, the load given to the display rotor plate 10 is intermittently released by the braking member 17, whereby the load on the step motor 20 of the rotation driving section 16 can be reduced. With this, the step motor 20 does not require a large driving force, and the display rotor plate 10 can be rotated with a small driving force. Also, power consumption by the step motor 20 can be reduced.

While the case has been described above in the first embodiment in which the date display section 8 having dates from first to thirty-first days is provided on the display rotor plate 10, the date display section 8 is not necessarily required to be provided. For example, a day-of-week display section having days of week from Sunday to Saturday or a month display section having months from January to December may be provided.

Second Embodiment

Next, with reference to FIG. 5 to FIG. 8A and FIG. 8B, a second embodiment in which the present invention has been applied to an electronic watch is described. Sections identical to those of the first embodiment depicted in FIG. 1 to FIG. 4A and FIG. 4B are provided with the same reference numerals for description.

Figure 5:
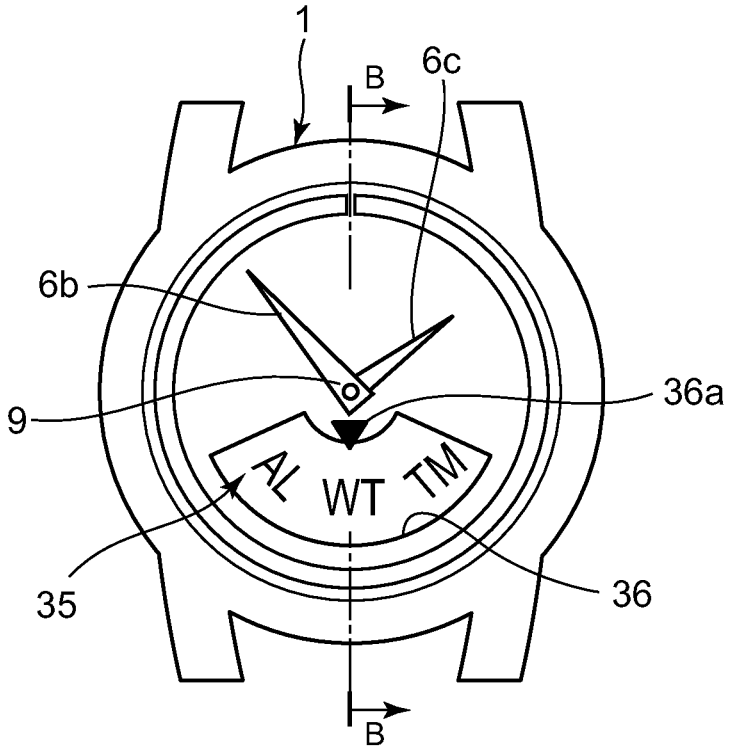
FIG. 5 is an enlarged front view of a second embodiment in which the present invention has been applied to an electronic watch.
Figure 6:
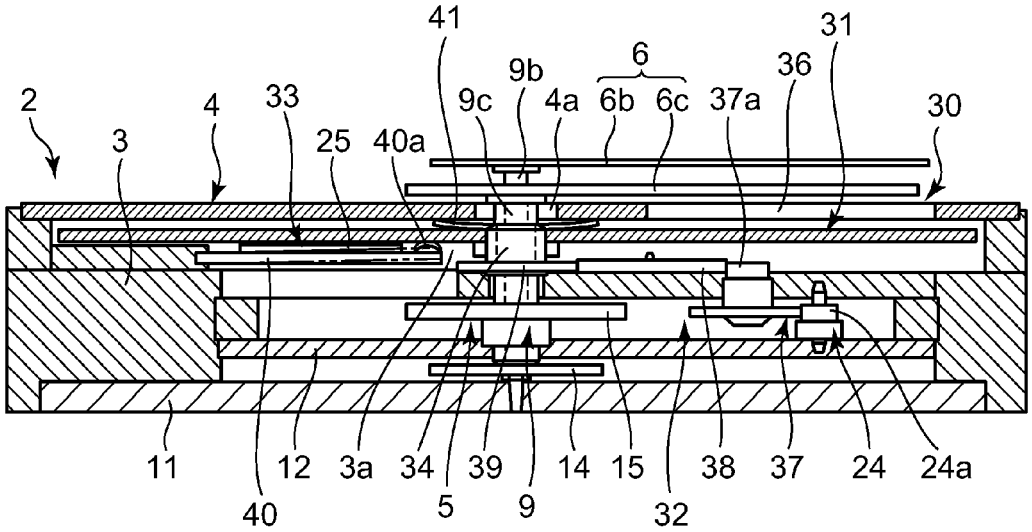
FIG. 6 is an enlarged sectional view of a timepiece module of the electronic watch taken along line B-B in FIG. 5.

As depicted in FIG. 5 and FIG. 6, the structure of the electronic watch is substantially the same as that of the first embodiment except an information display mechanism section 30 that is an information display device.

As depicted in FIG. 5 and FIG. 6, the information display mechanism section 30 includes a display rotor plate 31 (a rotor) rotatably placed below the hour plate 4, a rotation driving section 32 that causes the display rotor plate 31 to rotate, and a braking member 33 that brakes the rotation of the display rotor plate 31. The display rotor plate 31, which is a disk pointer, is formed in a substantially disk shape, and has its center part rotatably mounted on a display shaft 34 provided coaxially with the pointer shaft 9.

In this case, as depicted in FIG. 5 and FIG. 6, the pointer shaft 9 has the minute hand shaft 9*b* and the hour hand shaft 9*c*. With this, the pointers 6 include the minute hand 6*b* and the hour hand 6*c*. The display shaft 34 is positioned on the housing 3 and rotatably mounted on the outer perimeter of the hour hand shaft 9*c*. On the upper surface of the display rotor plate 31, as depicted in FIG. 5, a function display section 35 (a display section) is provided in which a plurality of functions such as alarm (AL), world time (WT), timer (TM), and stopwatch (not shown) are displayed.

As depicted in FIG. 5, the function display section 35 is structured so that one of the plurality of the functions such as alarm (AL), world time (WT), and timer (TM) are exposed corresponding to a display opening 36 (an opening) provided on the hour plate 4 so as to have a substantially fan shape, and one of the plurality of exposed functions is indicated by an indication mark 36*a*.

Figure 7:
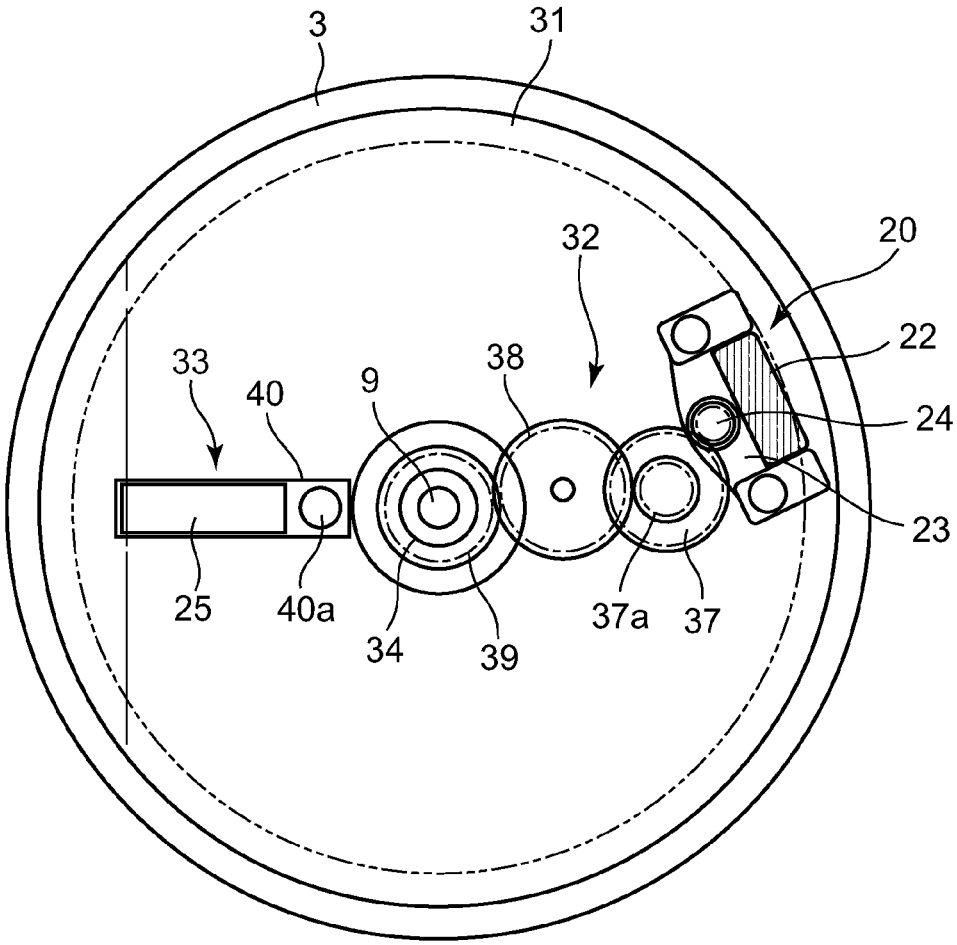
FIG. 7 is an enlarged rear view of the timepiece module depicted in FIG. 6.

As depicted in FIG. 6 and FIG. 7, the rotation driving section 32 includes the step motor 20, first and second intermediate wheels 37 and 38, and a display wheel 39. As with the first embodiment, the step motor 20 is structured so that, when an alternating current is given to the coil section 22 to cause an alternating magnetic field at the stator 23, the rotor 24 makes step rotation with this alternating magnetic field.

As depicted in FIG. 6 and FIG. 7, the first intermediate wheel 37 is structured to rotate engaging with the rotor pinion 24*a* of the rotor 24 of the step motor 20. The second intermediate wheel 38 is structured to rotate engaging with a pinion 37*a* of the first intermediate wheel 37. The display wheel 39 is structured to rotate engaging with the second intermediate wheel 38, whereby the display shaft 34 is rotated and the display rotor plate 31 is rotated.

As a result, the display rotor plate 31 is structured such that the rotation of the step motor 20 causes the display wheel 39 to rotate via the first and second intermediate wheels 37 and 38 as depicted in FIG. 6 and FIG. 7 and, with the rotation of the display wheel 39, the display rotor plate 31 rotates and switches a function display of the function display section 35 corresponding to the display opening 36 of the hour plate 4, as depicted in FIG. 5.

As depicted in FIG. 6 to FIG. 8A and FIG. 8B, the braking member 33 includes the piezoelectric element 25 that is deformed by energization, a vibrating plate 40 that vibrates with the deformation of the piezoelectric element 25, and a spring washer 41 (a resilient member) that resiliently presses the display rotor plate 31 onto the housing 3. In this case, the piezoelectric element 25 is provided on the upper surface of the vibrating plate 40. As depicted in FIG. 6 to FIG. 8A and FIG. 8B, the vibrating plate 40 is positioned in the brake accommodating section 3*a* provided to the housing 3, and one end (in FIG. 6, left end) of which is positioned on the outer perimeter side of the display rotor plate 31 and mounted on the inner side surface of the brake accommodating section 3*a* of the housing 3.

With this, as depicted in FIG. 6 to FIG. 8A and FIG. 8B, the vibrating plate 40 is structured so that its tip end side positioned on the center side of the display rotor plate 31 is warped and deformed in a vertical direction. The vibrating plate 40 is structured to have a tip end provided with a projection 40*a* projecting upward, and the projection 40*a* separably abuts on the lower surface of the display rotor plate 31.

As depicted in FIG. 6, the spring washer 41 is placed between the display rotor plate 31 and the hour plate 4. In the center of the spring washer 41, the hour hand shaft 9*c* of the pointer shaft 9 is rotatably inserted. With the display rotor plate 31 being resiliently pressed down together with the display shaft 34, the outer perimeter of the display rotor plate 31 is pressed onto the upper surface of the housing 3.

Figure 8A:
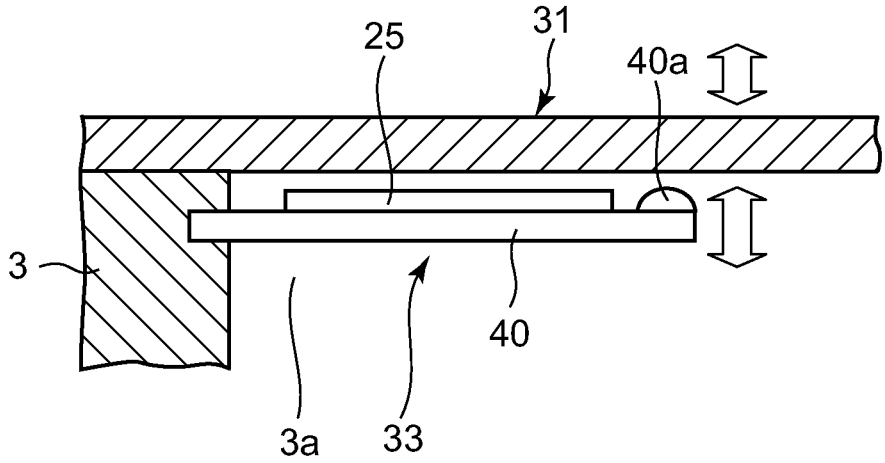

With this, as depicted in FIG. 8A, the braking member 33 is structured so that, when the piezoelectric element 25 is in a deenergized state, the projection 40*a* of the vibrating plate 40 is separated downward from the lower surface of the display rotor plate 31. In this state, by the outer perimeter of the display rotor plate 31 being pressed onto the upper surface of the housing 3 by the spring force of the spring washer 41, a load with a frictional resistance of the housing 3 can be given to the display rotor plate 31.

Figure 8B:
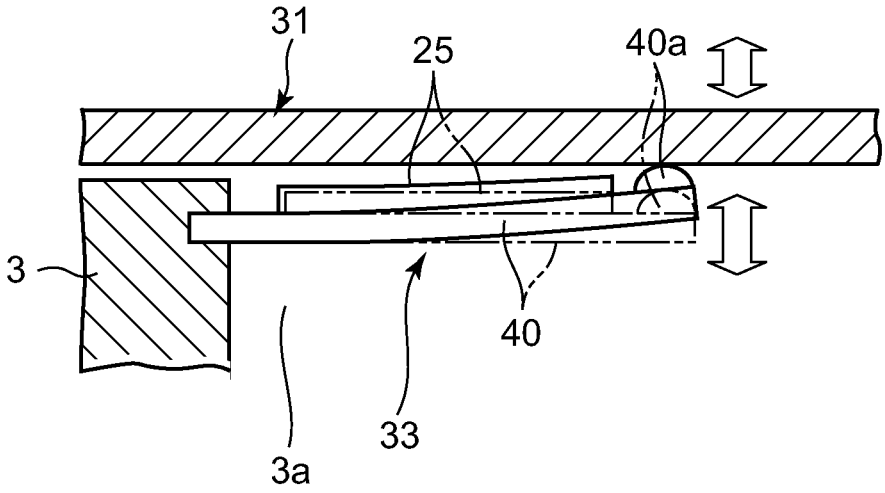

As depicted in FIG. 8B, the braking member 33 is structured so that, when the piezoelectric element 25 is in an energized state, the deformation of the piezoelectric element 25 causes the vibrating plate 40 to be warped and deformed in the vertical direction to vibrate. With this vibration, the projection 40*a* of the vibrating plate 40 is separated from and abuts on the lower surface of the display rotor plate 31 to intermittently push the outer perimeter of the display rotor plate 31 upward above the housing 3. With this, frictional resistance of the housing 3 with respect to the display rotor plate 31 is intermittently released to intermittently reduce the load on the display rotor plate 31.

Next, the operation of the electronic watch is described.

In the electronic watch, normally, the pointers 6 such as the minute hand 6*b* and the hour hand 6*c* move above the hour plate 4 to indicate the time, with the rotation of the pointer shaft 9 such as the minute hand shaft 9*b* and the hour hand shaft 9*c* in the timepiece mechanism section 5, as in the case of the first embodiment.

When one of the plurality of functions such as alarm (AL), world time (WT), and timer (TM) is to be switched, the braking member 33 of the information display mechanism section 30 is operated, and the rotation driving section 32 is also operated. By the rotation driving section 32, the display rotor plate 31 is rotated. With this, function display of the function display section 35 of the display rotor plate 31 is exposed corresponding to the display opening 36 of the hour plate 4, and the exposed function display is indicated by the indication mark 36*a*.

That is, here, the piezoelectric element 25 of the braking member 33 is first energized to be deformed. This deformation causes the vibrating plate 40 to be warped and deformed in the vertical direction to vibrate. With the vibration of the vibrating plate 40, the projection 40*a* of the vibrating plate 40 is separated from and abuts on the lower surface of the display rotor plate 31. Here, when the projection 40*a* of the vibrating plate 40 abuts on the lower surface of the display rotor plate 31 to press the display rotor plate 31 upward, the outer perimeter of the display rotor plate 31 floats from the upper surface of the housing 3, releasing frictional resistance of the housing 3 with respect to the display rotor plate 31. With this, the load on the display rotor plate 31 is intermittently reduced by the projection 40*a* of the vibrating plate 40.

In this state, when the rotation driving section 32 of the information display mechanism section 30 starts operation, the rotor 24 of the step motor 20 rotates. With the rotation of the rotor 24, the first and second intermediate wheels 37 and 38 rotate. With the rotation of the second intermediate wheel 38, the display wheel 39 rotates. With the rotation of the display wheel 39 the display rotor plate 31 rotates together with the display shaft 34.

Here, the projection 40*a* of the vibrating plate 40 of the braking member 33 is separated from and abuts on the lower surface of the display rotor plate 31, and the load on the display rotor plate 31 is intermittently reduced by the projection 40*a* of the vibrating plate 40. Therefore, with the rotation of the display wheel 39, the display rotor plate 31 smoothly rotates to switch the function display of the function display section 35 of the display rotor plate 31 corresponding to the display opening 36 of the hour plate 4.

As such, when the function display of the function display section 35 is switched, the operation of the step motor 20 in the rotation driving section 32 of the information display mechanism section 30 stops, and also the operation of the braking member 33 of the information display mechanism section 30 stops. That is, when the rotation of the step motor 20 of the rotation driving section 32 stops, the rotation of the display wheel 39 stops, thereby stopping the rotation of the display rotor plate 31. Here, in the state where the function display of the function display section 35 has been switched, the rotation of the display rotor plate 31 stops.

Also, energization of the piezoelectric element 25 of the braking member 33 is cut off to cause the piezoelectric element 25 to enter a deenergized state. Then, as depicted in FIG. 8A, the projection 40*a* of the vibrating plate 40 is separated from the lower surface of the display rotor plate 31, and the display rotor plate 31 is pressed down by the spring force of the spring washer 41.

With this, the outer perimeter of the display rotor plate 31 is pressed onto the upper surface of the housing 3. Then, by the friction force of the housing 3, a load is given to the display rotor plate 31. Therefore, even if the watch case 1 receives an external impact, the display rotor plate 31 is not rotated by the impact, and the function display of the function display section 35 is switched and the state of being indicated by the indication mark 36*a* is kept.

As such, the information display mechanism section 30 that is the information display device of the electronic watch includes the hour plate 4 having the display opening 36, the display rotor plate 31 rotatably placed below the hour plate 4, the display rotor plate 31 having the function display section 35 in which part of function display is exposed corresponding to the display opening 36 of the hour plate 4, and the braking member 33 which gives a load to the display rotor plate 31 when the rotation of the display rotor plate 31 is stopped, and reduces the load on the display rotor plate 31 when the display rotor plate 31 is rotating. This can prevent a positional shift of the function display due to an impact, and can allow the function display to be smoothly switched without requiring a large driving force.

That is, in the information display mechanism section 30, when the display rotor plate 31 is rotating, the load given to the display rotor plate 31 can be reduced by the braking member 33. Therefore, the display rotor plate 31 can be smoothly rotated without requiring a large driving force. Also, when the rotation of the display rotor plate 31 is stopped, the braking member 33 is separated from the display rotor plate 31, and the outer perimeter of the display rotor plate 31 is pressed by the spring washer 41 onto the housing 3, whereby the load can be given to the display rotor plate 31. Therefore, the display rotor plate 31 can be reliably prevented from rotating by an external impact.

With this, a positional shift of the function display of the function display section 35 can be prevented even if the watch case 1 receives an external impact. Also, the function display of the function display section 35 can be smoothly switched without requiring a large driving force. In addition, when the display rotor plate 31 is rotating, the load given to the display rotor plate 31 by the braking member 33 can be intermittently reduced, whereby the load on the step motor 20 of the rotation driving section 32 can be reduced. As a result, the step motor 20 does not require a large driving force, and the display rotor plate 31 can be rotated with a small driving force, as in the case of the first embodiment. Also, power consumption by the step motor 20 can be reduced.

In this case, the braking member 33 is structured to include the piezoelectric element 25 that is deformed by energization and the vibrating plate 40 that vibrates with the deformation of the piezoelectric element 25. When the piezoelectric element 25 is in a deenergized state, the vibrating plate 40 is separated from the display rotor plate 31 and the outer perimeter of the display rotor plate 31 is pressed onto the housing 3, thereby giving a load to the display rotor plate 31. When the piezoelectric element 25 is in an energized state, the vibrating plate 40 vibrates to intermittently release the load on the display rotor plate 31. Thus, when the display rotor plate 31 is rotating, the piezoelectric element 25 can be energized to reduce the load given to the display rotor plate 31. When the rotation of the display rotor plate 31 is stopped, energization of the piezoelectric element 25 can be cut off to give a load to the display rotor plate 31.

That is, with this braking member 33, when the piezoelectric element 25 is energized to be deformed while the display rotor plate 31 is rotating, the deformation causes the vibrating plate 40 to vibrate. Upon vibration, the vibrating plate 40 presses the display rotor plate 31 upward, thereby allowing frictional resistance of the housing 3 with respect to the display rotor plate 31 to be released. With this, the load on the display rotor plate 31 can be intermittently reduced. With this, the display rotor plate 31 can be smoothly rotated without requiring a large driving force.

Also, with this braking member 33, when the energization of the piezoelectric element 25 is cut off to stop the deformation of the piezoelectric element 25 while the rotation of the display rotor plate 31 is being stopped, the vibrating plate 40 is separated from the display rotor plate 31 to cause the display rotor plate 31 to be pressed onto the upper surface of the housing 3. With this, a load by frictional resistance of the housing 3 can be given to the display rotor plate 31. With this, the display rotor plate 31 can be reliably prevented from rotating due to an external impact. This can reliably prevent a positional shift of the function display of the function display section 35 even if an impact is received.

In this case, the braking member 33 includes the spring washer 41, which is a resilient member for giving a load to the display rotor plate 31 by resiliently pressing the display rotor plate 31 onto the housing 3. With this, the display rotor plate 31 can be reliably pressed onto the housing 3 by the spring force of the spring washer 41. With this, the display rotor plate 31 can be prevented from rotating by an external impact.

Furthermore, with this braking member 33, when the piezoelectric element 25 is energized to be deformed and this deformation causes the vibrating plate 40 to vibrate, the display rotor plate 31 is intermittently pushed up by vibration of the vibrating plate 40 against the spring force of the spring washer 41, thereby allowing the display rotor plate 31 to intermittently float over the upper surface of the housing 3. With this, the frictional resistance of the housing 3 with respect to the display rotor plate 31 can be intermittently released.

Third Embodiment

Figure 9:
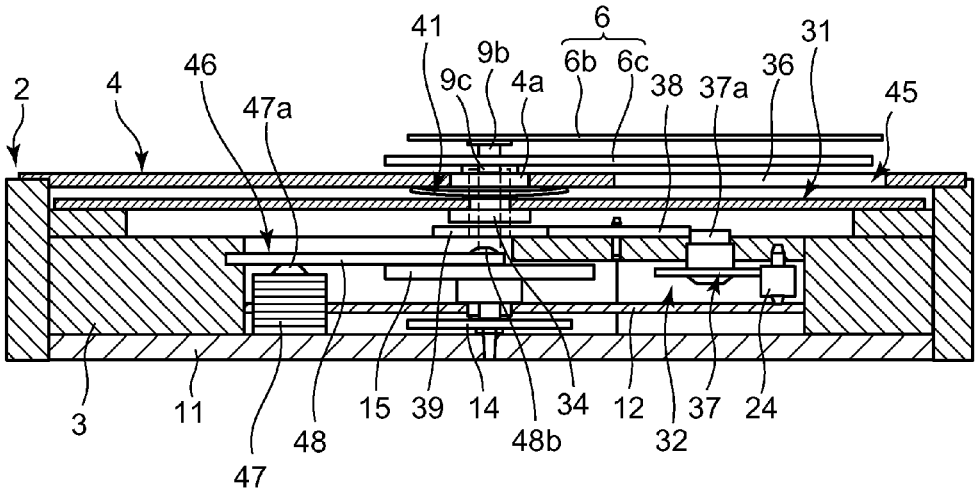
FIG. 9 is an enlarged sectional view of a timepiece module of a third embodiment in which the present invention has been applied to an electronic watch.
Figure 10:
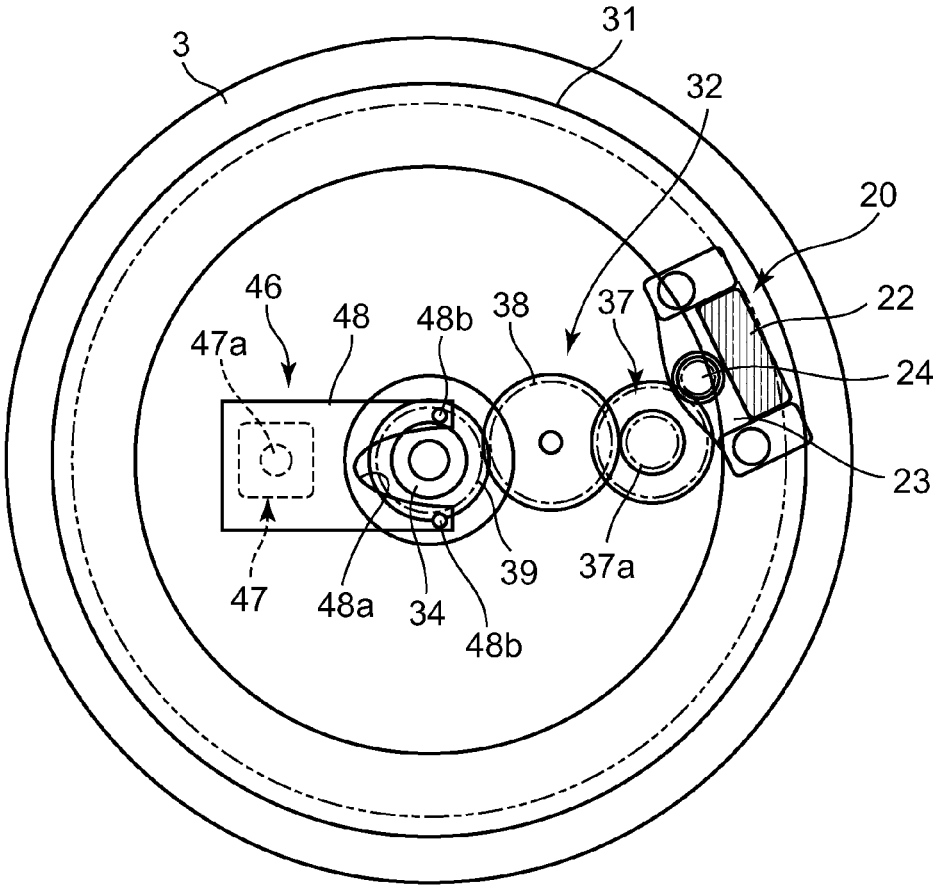
FIG. 10 is an enlarged rear view of the timepiece module depicted in FIG. 9.
Figure 11:
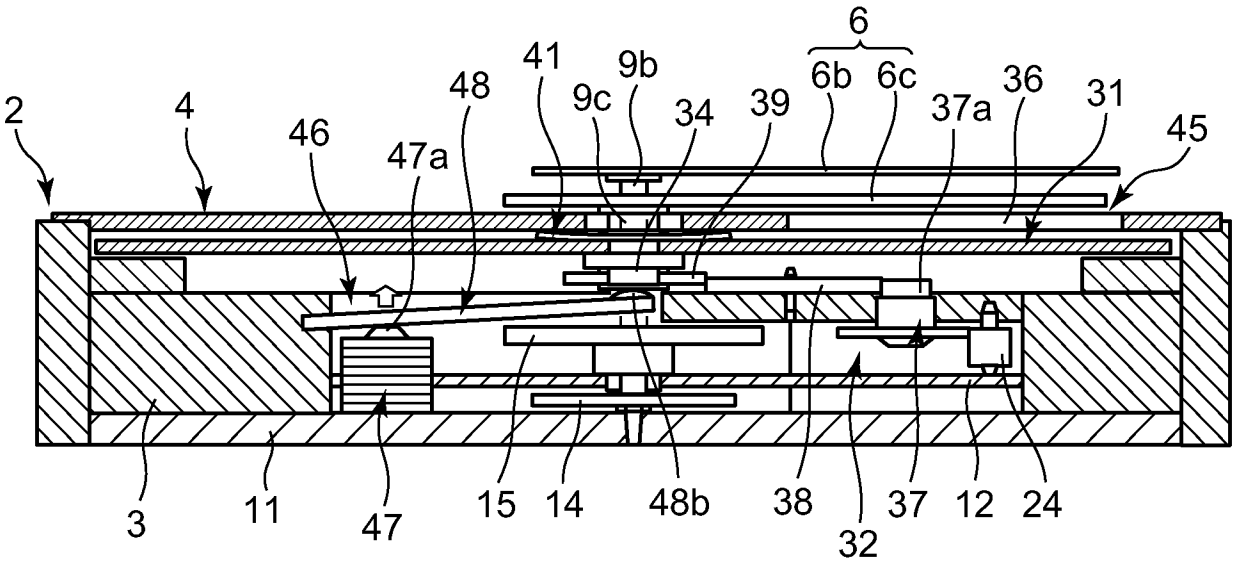
FIG. 11 is an enlarged sectional view of the state in which a pushing-up member pushes up a display rotor plate by a piezoelectric actuator in a braking member of the timepiece module depicted in FIG. 9.

Next, with reference to FIG. 9 to FIG. 11, a third embodiment in which the present invention has been applied to an electronic watch is described. In this case, sections identical to those of the second embodiment depicted in FIG. 5 to FIG. 8A and FIG. 8B are provided with the same reference numerals for description.

As depicted in FIG. 9 and FIG. 10, the structure of the electronic watch is substantially the same as that of the second embodiment except a braking member 46 of an information display mechanism section 45 that is an information display device.

As depicted in FIGS. 9 and 10, the braking member 46 includes a piezoelectric actuator 47 having an operator 47*a* that operates in a rising and setting direction when energized, and a pushing-up member 48 (an operating member) that is interlocked with the operator 47*a* of the piezoelectric actuator 47. The pushing-up member 48 is positioned in the brake accommodating section 3*a* provided to the housing 3, and the one end (in FIG. 9, left end) of which is positioned on the outer perimeter side of the display rotor plate 31 (a rotor) and mounted on the inner side surface of the brake accommodating section 3*a* of the housing 3.

As depicted in FIG. 9 and FIG. 10, the pushing-up member 48 is structured to have a tip end (in FIG. 10, right end) positioned on the center side of the display rotor plate 31 and provided with a notch 48*a* where the hour hand shaft 9*c* of the pointer shaft 9 is inserted. On both sides of the notch 48*a*, projections 48*b* are provided. The projections 48*b* abut on the lower surface of the display wheel 39 from downside. The piezoelectric actuator 47 is provided in the brake accommodating section 3*a* of the housing 3 and positioned on a lower side on one end side of the pushing-up member 48 positioned on the outer perimeter side of the display rotor plate 31.

With this, as depicted in FIG. 9 and FIG. 10, the braking member 46 is structured so that, when the piezoelectric actuator 47 is in a deenergized state, the pushing-up of the pushing-up member 48 by the operator 47*a* is released, and the display rotor plate 31 is pushed down by the spring force of the spring washer 41 to press the outer perimeter of the display rotor plate 31 onto the upper surface of the housing 3. With this, a load by a friction force of the housing 3 is given to the display rotor plate 31.

Also, as depicted in FIG. 11, the braking member 46 is structured so that, when the piezoelectric actuator 47 is in an energized state, the operator 47*a* projects upward and the pushing-up member 48 is pushed up by the operator 47*a* to push up the display rotor plate 31 against the spring force of the spring washer 41. With this, the display rotor plate 31 floats above the housing 3 to release frictional resistance of the housing 3 with respect to the display rotor plate 31, thereby reducing the load on the display rotor plate 31.

Next, the operation of the electronic watch is described.

In the electronic watch, normally, the pointers 6 such as the minute hand 6*b* and the hour hand 6*c* move above the hour plate 4 to indicate the time, with the rotation of the pointer shaft 9 such as the minute hand shaft 9*b* and the hour hand shaft 9*c* in the timepiece mechanism section 5, as in the case of the second embodiment.

When one of the plurality of functions such as alarm (AL), world time (WT), and timer (TM) is to be switched, the braking member 46 of the information display mechanism section 45 is operated, and the rotation driving section 32 is also operated. By the rotation driving section 32, the display rotor plate 31 is rotated. With this, function display of the function display section 35 of the display rotor plate 31 is exposed corresponding to the display opening 36 of the hour plate 4, and the exposed function display is indicated by the indication mark 36*a*.

That is, here, the piezoelectric actuator 47 of the braking member 46 is first energized to cause the operator 47*a* to project upward. By this projected operator 47*a*, the pushing-up member 48 is pushed upward. The projections 48*b* of the pushing-up member 48 push the display wheel 39 against the spring force of the spring washer 41.

Here, since the display rotor plate 31 is pushed up together with the display wheel 39, the outer perimeter of the display rotor plate 31 floats from the upper surface of the housing 3, thereby releasing frictional resistance of the housing 3 with respect to the display rotor plate 31. With this, the load on the display rotor plate 31 is reduced by the projections 48*b* of the pushing-up member 48 with the operator 47*a* of the piezoelectric actuator 47.

In this state, when the rotation driving section 32 of the information display mechanism section 45 starts operation, the rotor 24 of the step motor 20 rotates. With the rotation of the rotor 24, the first and second intermediate wheels 37 and 38 rotate. With the rotation of the second intermediate wheel 38, the display wheel 39 rotates. With the rotation of the display wheel 39, the display rotor plate 31 rotates together with the display shaft 34.

Here, the display rotor plate 31 is pushed up by the pushing-up member 48 of the braking member 46 to release frictional resistance of the housing 3 with respect to the display rotor plate 31. With this, the load on the display rotor plate 31 is reduced. Therefore, with the rotation of the display wheel 39, the display rotor plate 31 smoothly rotates to switch the function display of the function display section 35 of the display rotor plate 31 corresponding to the display opening 36 of the hour plate 4.

As such, when the function display of the function display section 35 is switched, the operation of the step motor 20 in the rotation driving section 32 of the information display mechanism section 30 stops to stop the rotation of the display wheel 39, thereby stopping the rotation of the display rotor plate 31. Here, in the state where the function display of the function display section 35 has been switched, the rotation of the display rotor plate 31 stops.

Here, energization of the piezoelectric actuator 47 of the braking member 46 is out off and, as depicted in FIG. 9, pushing-up by the operator 47*a* of the piezoelectric actuator 47 is released. Then, pushing-up of the display rotor plate 31 by the pushing-up member 48 is also released, thereby pushing down the display rotor plate 31 by the spring force of the spring washer 41.

With this, the outer perimeter of the display rotor plate 31 is pressed onto the upper surface of the housing 3. With the friction force of the housing 3, a load is given to the display rotor plate 31. Therefore, even if the watch case 1 receives an external impact, the display rotor plate 31 is not rotated by the impact, and the function display of the function display section 35 is switched and the state of being indicated by the indication mark 36*a* is kept.

As such, the information display mechanism section 45 of the electronic watch includes the hour plate 4 having the display opening 36, the display rotor plate 31 rotatably placed below the hour plate 4, the display rotor plate 31 having the function display section 35 in which part of function display is exposed corresponding to the display opening 36 of the hour plate 4, and the braking member 46 which gives a load to the display rotor plate 31 when the rotation of the display rotor plate 31 is stopped, and reduces the load on the display rotor plate 31 when the display rotor plate 31 is rotating. As with the second embodiment, this can prevent a positional shift of the function display due to an impact, and can allow the function display to be smoothly switched without requiring a large driving force.

That is, in the information display mechanism section 45, when the display rotor plate 31 is rotating, the load given to the display rotor plate 31 can be reduced by the braking member 46. Therefore, the display rotor plate 31 can be smoothly rotate without requiring a large driving force. Also, when the rotation of the display rotor plate 31 is stopped, the braking member 46 is separated from the display rotor plate 31, and the outer perimeter of the display rotor plate 31 is pressed by the spring washer 41 onto the housing 3, whereby the load can be given to the display rotor plate 31. Therefore, the display rotor plate 31 can be reliably prevented from rotating by an external impact.

With this, a positional shift of the function display of the function display section 35 can be prevented even if the watch case 1 receives an external impact. Also, the function display of the function display section 35 can be smoothly switched without requiring a large driving force. In addition, when the display rotor plate 31 is rotating, the load given to the display rotor plate 31 can be reduced by the braking member 46, whereby the load on the step motor 20 of the rotation driving section 32 can be reduced. As a result, the step motor 20 does not require a large driving force, and the display rotor plate 31 can be rotated with a small driving force, as in the case of the second embodiment. Also, power consumption by the step motor 20 can be reduced.

In this case, the braking member 46 is structured to include the piezoelectric actuator 47 having the operator 47*a* that operates in the rising and setting direction when energized, and the pushing-up member 48 that is interlocked with the operator 47*a* of the piezoelectric actuator 47. When the piezoelectric actuator 47 is in a deenergized state, a load is given by the pushing-up member 48 to the display rotor plate 31. When the piezoelectric actuator 47 is in an energized state, the load on the display rotor plate 31 is reduced by the pushing-up member 48. As a result, when the display rotor plate 31 is rotating, the piezoelectric actuator 47 can be energized to reduce the load given to the display rotor plate 31. Also, when the rotation of the display rotor plate 31 is stopped, energization of the piezoelectric actuator 47 can be cut off to reliably give a load to the display rotor plate 31.

That is, with this braking member 46, when the piezoelectric actuator 47 is energized to project the operator 47*a* while the display rotor plate 31 is rotating, the pushing-up member 48 is pushed up. By the pushing-up member 48, the display rotor plate 31 is pushed up, thereby releasing frictional resistance of the housing 3 with respect to the display rotor plate 31. Therefore, the load on the display rotor plate 31 can be reduced. With this, the display rotor plate 31 can be smoothly rotated without requiring a large driving force.

Also, with this braking member 46, when energization of the piezoelectric actuator 47 is cut off while the rotation of the display rotor plate 31 is being stopped, the pushing-up member 48 is pushed down together with the display rotor plate 31 by the spring force of the spring washer 41, and separated from the display rotor plate 31. By the display rotor plate 31 being pressed onto the upper surface of the housing 3, a load with frictional resistance of the housing 3 can be given to the display rotor plate 31. This can reliably prevent the display rotor plate 31 from rotating due to an external impact, and therefore can reliably prevent a positional shift of the function display of the function display section 35 even if an impact is received.

While the case has been described in the second and third embodiments in which a function, such as alarm (AL), world time (WT), and timer (TM), is displayed on the function display section 35 of the display rotor plate 31, this is not meant to be restrictive. For example, a structure may be adopted in which temperature, humidity, atmospheric pressure, waxing and waning of the moon, rising and falling of the tides, or the like is displayed.

While the case has been described in the first to third embodiments in which the present invention has been applied to a pointer-type electronic watch, the present invention is not necessarily required to be applied to an electronic watch. For example, the present invention can be applied to various pointer-type electronic timepieces such as a travel watch, an alarm clock, a table clock, a wall clock, etc.

While the present invention has been described with reference to the preferred embodiments, it is intended that the invention be not limited by any of the details of the description therein but includes all the embodiments which fall within the scope of the appended claims.

What is claimed is:

1. An information display device comprising:

an hour plate which has an opening;

a rotor which is rotatably placed below the hour plate, and has a display section which is partially exposed corresponding to the opening of the hour plate;

a rotation driving section which rotates the rotor; and a braking member which gives a load to the rotor when the rotation driving section stops and rotation of the rotor is stopped, and reduces the load on the rotor when the rotation driving section starts operation and the rotor is rotating.

2. The information display device according to claim 1, wherein the braking member comprises a piezoelectric element which is deformed by energization, and a vibrating plate which vibrates along with deformation of the piezoelectric element, and wherein the load is given to the rotor by the vibrating plate when the piezoelectric element is in a deenergized state, and the vibrating plate vibrates to intermittently release the load on the rotor when the piezoelectric element is in an energized state.

3. The information display device according to claim 1, wherein the braking member comprises a piezoelectric actuator having an operator that operates in a rising and setting direction when energized, and an operating member which operates in conjunction with the operator of the piezoelectric actuator, and wherein the operating member is operated by the operator to give the load to the rotator when the piezoelectric actuator is in a deenergized state, and reduces the load on the rotor by the operating member when the piezoelectric actuator is in an energized state.

4. The information display device according to claim 2, wherein the braking member comprises a resilient member which gives the load to the rotor by resiliently pressing the rotor onto a fixing member.

5. The information display device according to claim 3, wherein the braking member comprises a resilient member which gives the load to the rotor by resiliently pressing the rotor onto a fixing member.

6. An electronic timepiece comprising the information display device according to claim 1.

7. An electronic timepiece comprising the information display device according to claim 2.

8. An electronic timepiece comprising the information display device according to claim 3.

9. An electronic timepiece comprising the information display device according to claim 4.

10. An electronic timepiece comprising the information display device according to claim 5.

* * * * *